United States Patent [19]

Kingelin

[11] 4,051,897

[45] Oct. 4, 1977

[54] WELL TESTING TOOL

[75] Inventor: George F. Kingelin, Rosenberg, Tex.

[73] Assignee: Gulf Research & Development Company, Pittsburgh, Pa.

[21] Appl. No.: 645,420

[22] Filed: Dec. 30, 1975

[51] Int. Cl.[2] ..... E21B 23/02

[52] U.S. Cl. ..... 166/125; 166/113; 166/133

[58] Field of Search ..... 166/115, 116, 125, 136, 166/215, 250, 315, 113, 133

[56] References Cited

U.S. PATENT DOCUMENTS

| | | | |
|---|---|---|---|
| 2,404,825 | 7/1946 | Brown et al. | 166/116 |
| 2,671,512 | 3/1954 | Ragan et al. | 166/115 |
| 2,842,212 | 7/1958 | Lebourg | 166/125 |
| 3,011,549 | 12/1961 | Fredd et al. | 166/115 |
| 3,198,257 | 8/1965 | Myers | 166/133 X |
| 3,633,670 | 1/1972 | Brown et al. | 166/125 |

*Primary Examiner*—Ernest R. Purser

[57] ABSTRACT

A tool for testing conditions at a specific depth in a well is run into the well on a wire line and set in a locking mandrel which in turn is set in a landing nipple in tubing string in the well. The tool is adapted to seal against the wall of the central bore through the locking mandrel and is locked in position by engagement of locking dogs on the tool in a recess in the fishing neck of the locking mandrel. The locking dogs are in a sleeve which surrounds and is slidable longitudinally along the body of the tool. On lifting the tool with a wire line to cause upward movement of the body relative to the sleeve, pressure release ports are moved to a communicating position and the locking dogs are withdrawn to disengage the locking mandrel to permit retrieval of the tool. The tool is of particular value in measuring the pressure or temperature in the well at a specific depth but is suitable for a wide variety of uses in which it is necessary to isolate temporarily a portion of the well.

14 Claims, 3 Drawing Figures

WELL TESTING TOOL

BACKGROUND OF THE INVENTION

This invention relates to the production of oil, gas or water from wells and more particularly to apparatus that is useful for measuring conditions existing at a specific depth in the well and is capable of being run into a well, set, and retrieved from the well on a wire line.

Occasionally it is necessary to run a tool into a well and set the tool to isolate that part of the well below the tool from that part of the well above the tool. For example, it may be desirable to measure the temperature or pressure of well fluids at a specific depth in the wall. On some occasions it is desirable to direct all of the flow upwardly through a well at a selected depth through a flow meter to obtain information of value in production of fluids from the well. After the testing of the well has completed, the tools or instruments used in the testing are removed either to remove obstructions to flow or to permit running other tools into the well. It is desirable that the tools or instruments used in the testing be capable of being run into the well, set, operated and retrieved by wire line to leave the well in a fully open condition that existed prior to the testing.

Isolation of a lower portion of a well from a higher portion is ordinarily accomplished by setting a packer in the well. Many packers are mechanically set by rotating a portion of the packer to cause a sleeve to move along threads and thereby exert forces against the ends of a sealing element that distort the sealing element to engage the inner wall of casing or other conduit in the well. To accomplish the relative rotation of parts of the packer, such packers ordinarily are run into the well on tubing and include a friction element that will engage the wall of casing or other conduit in which it is set to prevent rotation of the packer as the tubing on which it is run into the well is rotated. Another type of packer is run into the well on tubing and a plug dropped into the packer to prevent flow through its lower end. Thereafter, liquid is pumoed down the tubing to develop hydraulic pressure that moves piston-like elements that compress sealing elements to set the packer. Both the mechanically set packers and the hydraulically set packers require a rig for running tubing on which the packer is mounted into the well and removing it from the well after testing has been completed. If the testing is to extend over an appreciable period, the rig must either remain at the well during the testing or make a second trip for removal of the packer after the testing has been completed. If the packer is left in the well, it severely restricts the borehole opening and may interfere with subsequent production from the well. A mechanically set packer used to isolate the lower part of the well for a testing device is described in U.S. Pat. No. 2,702,474 of Johnston.

Wire line operated packers have been developed to avoid the cost of a derrick to run the packer and pull it when removal of the packer is desired. Such packers have a substantial length including slips and the sealing elements over which there is a very small clearance between the inner wall of the tubing and the packer. Because of the length of the wire line operated packers over which there is a very small clearance with the tubing, it is difficult to run the packers into tubing and often impossible to retrieve them. Bending, twisting or flattening of the tubing often prevents use of the wire line operated packers. Moreover, pitting, scoring or other damage to the tubing during use frequently prevents obtaining a seal which will allow the control needed for accurate test of the well.

Electrically operated packers have been developed for use with sensitive electrical instruments requiring an electric line. Such packers are described in U.S. Pat. Nos. 3,503,444 and 3,542,126 of Arthur L. Owen. The packers are run to the desired depth on an electric wire line. An electric motor in the packer is then utilized to compress sealing means and move them outwardly against the wall of the tubing or casing in which the packer is set. In some instances, a motor-driven pump is used to inflate a flexible bag-type packer. U.S. Pat. Nos. 3,503,444 and 3,542,126 describe testing tools for measuring conditions at a specific depth in a well that utilize an electric motor to set the packer. These packers are also quite long, have a very small clearance and, additionally, require electrical power for operation. Loss of power after the packer is set can be disastrous.

SUMMARY OF THE INVENTION

This invention resides in a tool that can be run into a well on a wire line, set to lock the tool in place and isolate that portion of the well below the tool from the portion above the tool, and utilized to test conditions in the well at the level of the tool. After the test has been completed, the tool can be retrieved on a wire line and leave the conduits in the well fully open. The tool seals against and is held in place in a locking mandrel that is landed and set in a landing nipple that forms a part of the tubing string of the well when the well is completed. The tool of this invention includes a body adapted for connection at its upper end, either directly or through another tool, to a wire line and a sleeve surrounding the body and longitudinally slidable thereon over a limited range. Dogs in the sleeve are movable between an inner position in which the tool is run into the well and an outer position in which the dogs enter locking recesses in the locking mandrel to hold the tool in the locking mandrel. A stinger extending downwardly below the sleeve and body into the longitudinal opening through the locking mandrel has annular sealing means adapted to engage the wall of the opening in the locking mandrel to prevent flow between the locking mandrel and the stringer. Upward movement of the body relative to the sleeve places conduits in communication to equalize pressure above and below the tool to facilitate retrieval. Dog releasing means are adapted to retract the dogs to the inner running position on such upward movement. In a preferred embodiment, a passage in the stinger communicates with a duct into a housing to transmit well fluids or pressure from below the sealing means to an instrument mounted in the housing.

DESCRIPTION OF PREFERRED EMBODIMENT

Figure 1:
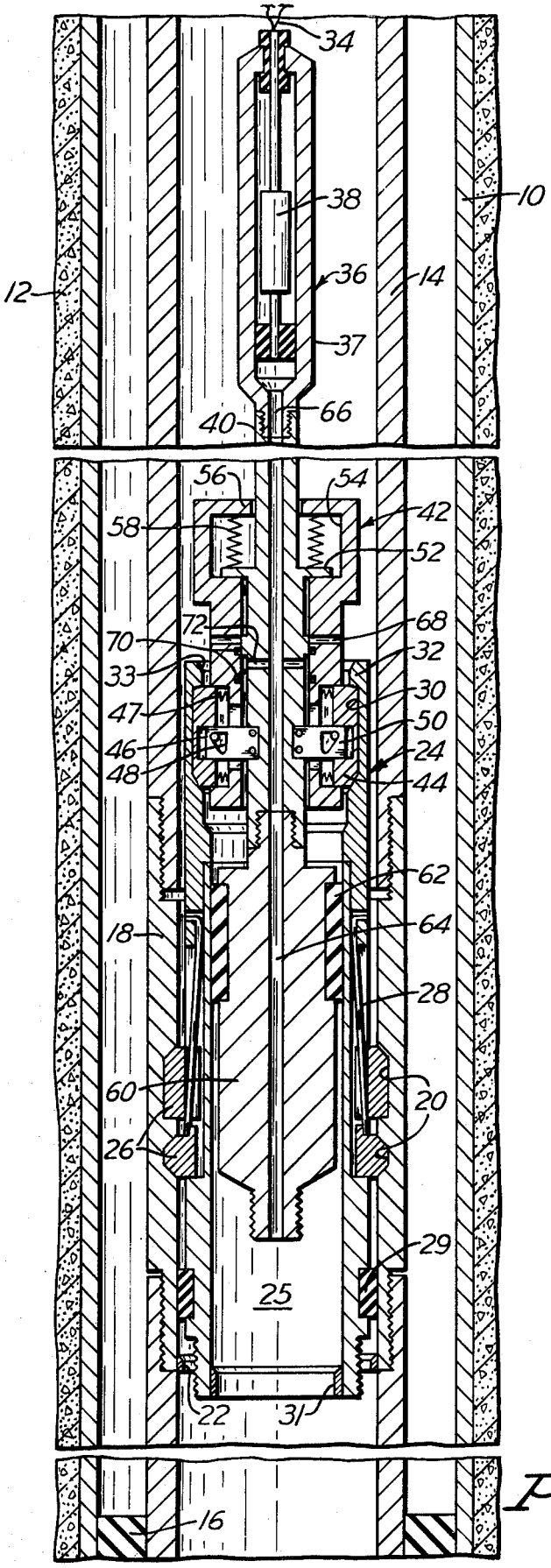
FIG. 1 is a longitudinal sectional view of the wall testing tool of this invention in position for conducting a test.

Referring to FIG. 1 of the drawings, a portion of a well is shown having casing 10 cemented in place in accordance with conventional practice with a sheath 12 of cement filling the space between the outer surface of the casing and the borehole wall. A tubing string 14 extending down the well within the casing is secured by a packer 16 closing the space between the casing 10 and tubing 14 near the lower end of the tubing.

Tubing sting 14 includes as a part thereof a landing nipple 18. Landing nipples are conventionally included as part of a tubing string during initial completion of the well to provide a means for landing tools during later operation or maintenance of the well. Virtually all wells are completed with one or more landing nipples in the tubing string positioned at intervals to permit landing of flow control or measuring devices at desired depths. The landing nipple 18 is constructed of a corrosion resistant metal such as stainless steel and has a polished bore very nearly the same size as the bore of the tubing string to eliminate as much as possible an increase in resistance to flow through the tubing. For example, a well-known commercial landing nipple installed in tubing having an internal bore 1.995 inches in diameter has a bore 1.875 inches in diameter. Thus, the landing nipple cause substantially no restriction of flow through the tubing. Landing nippe 18 has locking grooves 20 in its inner wall to receive locking dogs of a locking mandrel, as hereinafter described. A collar 22 at the lower end of the landing nipple may be provided to prevent tools from falling through the lower end of the landing nipple.

Seated in the landing nipple 18 is a locking mandrel diagrammatically shown in the drawings and indicated generally by reference numeral 24. Locking mandrel 24 is a tubular member with a longitudinal opening 25 extending its full length and having locking dogs 26 near the lower end thereof urged outwardly by springs 28 into the locking grooves 20 in the landing nipple. Sealing elements 29, such as chevron packing, below the locking dogs 26 engage the inner wall of the landing nipple to prevent flow between the locking mandrel and the landing nipple. A collar 31 may be provided at the lower end of the locking mandrel to prevent tools falling through the locking mandrel. The internal diameter of locking mandrel 24 is enlarged at its upper end to form a looking recess 30. Inwardly extending shoulder 32 at the upper end of locking recess 30 combines with the locking recess to form an inside fishing head for use in removal of the locking mandrel from the landing nipple. Shoulder 32 also serves to hold the tool of this invention in place, as hereinafter described. The upper end of shoulder 32 is beveled inwardly at 33 to facilitate running tools into the mandrel.

The outside diameter of the sealing element 29 is substantially the same as the inner bore of the landing nipple because the sealing elements 29 are expanded after the locking mandrel enters the landing nipple and pressed against the wall of the bore through the landing nipple to make an effective seal. Typically, the necessary expansion of sealing elements of locking mandrels is accomplished by jarring the mandrel after the dogs 26 enter the grooves 20. Although the clearance between the sealing elements 29 on the locking mandrel and the inner wall of the tubing is small, that small clearance is limited to a relatively short length of the tool; consequently, bends in, flattening of, or obstructions in the tubing that would prevent running a conventional wire line operated packer can be traversed by a locking mandrel. A locking mandrel is a rugged tool that can be forced past obstructions in the tubing by jarring or blows that would seriously damage or destroy many instruments.

Connected to a wire line 34 that extends down the well from the well head is a tool body indicated generally by reference numeral 36. Wire line 34 can be a slick line but is preferably an electric line suitably insulated from well fluids to transmit an unaltered signal from the tool body to the well head. In the embodiment shown, tool body 36 includes a housing 37 for a pressure gauge that includes a transducer 38 adapted to send a signal to the well head through the wire line 34. Although one of the principal uses of this invention is to measure the pressure at a downhole location, it is not limited to such use, and instruments or apparatus other than pressure gauges can be installed in place of transducer 38 in the housing 37 or otherwise attached to body 36. For example, other instruments such as temperature indicators or flow meters may be installed in the housing 37 and suitably connected to the wire line 34 to transmit to the well head any measurements made by the instrument. If a flow meter is mounted on the body 36, an outlet from the body is provided through which the well fluids are discharged from the flow meter. The tool can be used to obtain a sample of well fluids at the level of the tool, and operation of the sampler can be controlled by signals delivered through the line 34.

Figure 2:
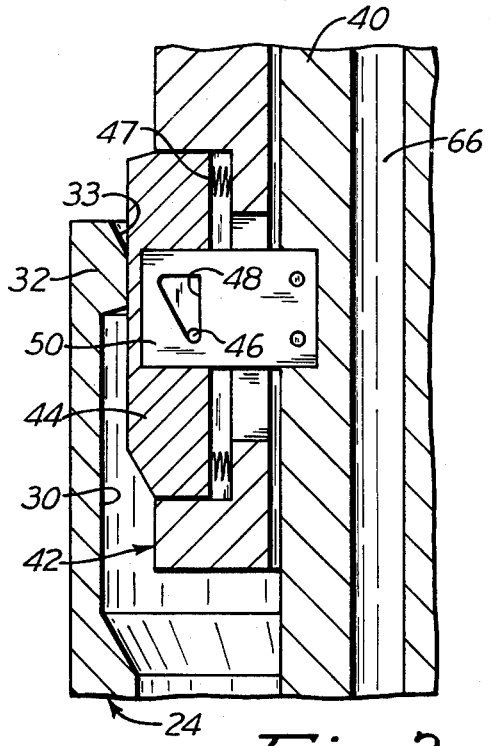
FIG. 2 is a longitudinal sectional view showing the position of the locking dogs of the tool as it is pulled from the well.

Forming a part of body 36 is a stem 40 which is shown in the embodiment illustrated as attached to the lower end of housing 37 and extending downwardly at least as far as locking recess 30 of locking mandrel 24. Surrounding and slidable longitudinally on the stem 40 is a sleeve 42. A plurality of locking dogs 44 spaced apart around the sleeve are mounted in the lower end of sleeve 42 in a manner that permits their movement between an outer position, shown in FIG. 1, in which the dogs extend into the locking recess 30 of locking mandrel 24 and an inner position, shown in FIG. 2, which allows the dogs to clear the shoulder 32 for running into and withdrawal from the locking mandrel. Movement of the dogs is controlled by suitable cam means such as cam followers 46 that extend from the dogs into cam slots 48 in tabs 50 secured to the stem 40 of body 36. Helical springs 47 urge the dogs outwardly into the locking recess.

Movement of the sleeve 42 relative to the body 36 is limited by a lip 52 that extends outwardly from the stem 40 into a chamber 54 at the upper end of sleeve 42. The upper end of the chamber 54 is bounded by an inwardly extending flange 56. A helical spring 58 compressed between flange 56 and lip 52 urges flange 56 and, hence, sleeve 42 upward relative to the lip 52 and body 36. Spring 58, therefore, urges cam follower 46 toward the upper end of cam slots 48 and thereby urges locking dogs 44 to the outer position.

Connected to the lower end of stem 40 is a stinger 60 having suitable sealing means 62 such as chevron packing or O-rings to prevent flow between the outer surface of the stinger and the wall of the longitudinal opening through the locking mandrel.

In the embodiment of the invention in which the tool is used for measurement of the pressure, temperature, or flow rate at the bottom of the wall or to obtain a sample, communication between the well below the packing means 62 and the instrument in the housing 37 is provided by a passage 64 extending longitudinally through the stinger which communicates with a duct 66 in the stem 40. Duct 66 opens at its upper end into the lower end of the housing 37 at the upper end of body 36. To relieve any difference between the pressures above and below the tool as the tool is withdrawn from the locking mandrel, as is hereinafter described, pressure relief conduits 68 intersect duct 66. During normal operation of the tool, flow through conduits 68 is prevented by sealing rings 70 engaging the stem and the sleeve. Ports 72 in the sleeve are positioned to communicate with the conduit 68 when the body 36 is lifted relative to sleeve 42.

Figure 3:
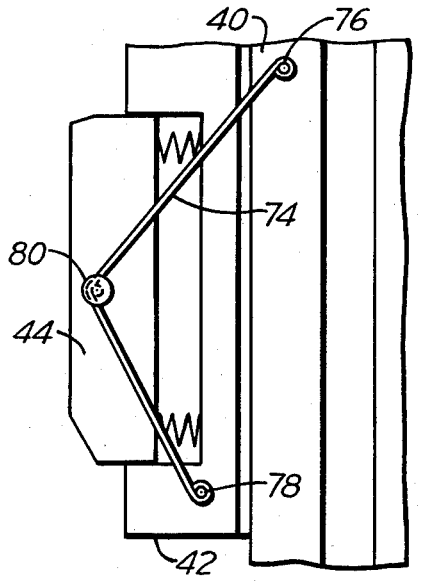
FIG. 3 is a diagrammatic view in elevation of a second embodiment of locking dog releasing means that can be used in this invention.

In FIG. 3, another embodiment of apparatus for withdrawing locking dogs 44 from the locking recess in the locking mandrel is illustrated. One end of a flexible bar spring 74 is connected at 76 to the stem 40 and the other end at 78 to the sleeve 42. Spring 74 passes slidably over a pin 80 on the locking dogs 44. When the sleeve 42 is at its uppermost position relative to stem 40, the bar spring 74 has a sharp bend at 80. When the stem 40 is moved upwardly relative to the sleeve 42, bar spring 74 is straightened and retracts dogs 44 from the locking recess in the locking mandrel.

In the operation of the tool of this invention, the locking mandrel 24 is run into the well on a wire line and set in the landing nipple and the running in tool on which the locking mandrel is run into the well is retrieved in accordance with customary procedures for landing locking mandrels. The tool, including any instrument desired, is assembled with the sleeve 42 surrounding the stem 40 and is run into the well on wire line 34. The stinger 60 enters the upper end of the longitudinal opening 25 through the locking mandrel. The weight of the tool is ordinarily adequate to move the tool downwardly in the locking mandrel to a position at which the packing elements 62 seal against the wall of the opening 25. If additional weight is required, it can be provided, for example, by incorporating a suitable sub at the upper end of body 36, between the stem 40 and the housing 37, or at the lower end of the stringer 60.

As the tool is lowered, the beveled lower ends of locking dogs 44 engage the inwardly sloping upper end 33 of shoulder 32 to compress springs 47 and move the locking dogs 44 inwardly to clear the shoulder 32. As the toolis lowered sufficiently for the upper end of dogs 44 to clear the lower end of shoulder 32, springs 47 move the dogs upwardly into the locking recess of the locking mandrel to hold the tool against the bottom pressure tending to force the tool upwardly from the locking mandrel. The tool is then in the condition illustrated in FIG. 1 of the drawings. The bevel at the upper end of dogs 44 and at the lower surface of shoulder 32 is such that the dogs are not disengaged by the upward force of wall fluids against the stinger 60 and, through spring 58, against the sleeve 42. Compressed spring 58 prevents upward movement of tool body 36 relative to the sleeve 42 until the force of spring 58 is overcome. If the stinger should be attached to the lower end of sleeve 42, the upward force of the well fluids would be transmitted directly to the dogs 44 but the bevel at their upper end is such that they would not be released without upward movement of body 36 relative to sleeve 42.

If the tool is used to measure the pressure below the landing nipple 18, fluid pressure is transmitted through passage 64 and duct 66 to the instrument 38. Preferably, instrument 38 is of the type adapted to emit an electrical signal that is transmitted through electric line 34 to the well head. In some instances, a pressure recording device may be mounted within the housing 37 constituting a part of body 36 in which instance a fishing head may be provided at the upper end of the housing.

When it is desired to retrieve the tool, the tool is lifted by means of line 34. As a lifting foce is exerted on line 34, upward movement of the sleeve 42 is resisted by engagement of the upper end of the locking dogs 44 with the shoulder 32 at the upper end of the locking recess in mandrel 24. The stem 40 is moved upwardly by the force exerted on line 34 whereupon engagement of cam followers 46 with the edges of cam slots 48 moves the dogs 44 inwardly until they are able to clear the inner surface of shoulder 32 to allow the tool to be pulled from the locking mandrel. As the stem 40 moves upwardly, ports 72 are moved to a position in alignment with conduits 68 to equalize the pressure above and below the tool before dogs 44 are released from engagement with shoulder 32. Uncontrolled movement of the tool up the well is prevented thereby. After the tool has been retrieved from the well, the locking mandrel can be retrieved by conventional procedures used for retrieving locking mandrels.

The setting of the tool in the locking mandrel facilitates running the tool into the well by avoiding the close tolerances through the tubing that would be necessary if the tool were set directly in the landing nipple. Danger of the tool becoming stuck in the hold either as it is run into the well or during retrieval is thereby eliminated. Although the locking mandrel necessarily has close tolerances the with the landing nipple, the ruggedness of a locking mandrel permits it to be subjected to forces and blows to move it down the tubing that would destroy test instruments if such instruments if such instruments were suspended from the locking mandrel and run into the well on the locking mandrel. Moreover, if a locking mandrel becomes stuck in the tubing and must be destroyed, its cost is far below the cost of instruments used in well testing procedures.

The tool can be run, set and retrieved on a wire line. Round trips with tubing can thereby be avoided as can the need for a derrick to run tubing into, or pull tubing from, the well. The wire line may be an electric line that runs to the surface and provides observation at the surface of conditions at the preselected level in the well during the testing operation.

An important advantage of the tool of this invention is that it can be set in most wells even though the wells may have been completed years ago. Most wells are completed with landing nipples in the tubing string. It is possible, therefore, to avoid making a round trip with tubing before, during, or after testing. After testing tool and the locking mandrel have been retrieved by wire line, the tubing is fully open. The testing apparatus and method of this invention does not leave any obstruction to flow in the well that requires pulling the tubing to return the well to a full flow condition.

The "instrument" in the tool may be any of a wide variety of equipment. For example, the housing 37 may be empty and the tool then serve as a plug adapted to kill the well to permit work at the well head. The tool can then be pulled without removing the locking mandrel.

I claim:

1. In apparatus for use in a well having a tubing string extending down a borehole, a landing nipple connected in and forming a part of the tubing string and a locking mandrel set in the landing nipple, said locking mandrel having an opening extending longitudinally therethrough and a locking recess in the wall of the opening, a tool adapted to be run into the locking mandrel and retrieved therefrom on a wire line comprising an elongated stem, a stinger below the stem extending downwardly in the longitudinal opening in the locking mandrel, sealing elements around the stinger adapted to engage the wall of the opening through the locking mandrel positioned to prevent flow through the locking mandrel between the locking mandrel and the stem, a sleeve concentric with and longitudinally slidable on the stem, means limiting longitudinal movement of the sleeve relative to the stem, locking dogs constructed and arranged to move radially outward in the sleeve into the locking recess of the locking mandrel to prevent movement of the tool upwardly relative to the mandrel, and locking dog releasing means operable on lifting the tool to move the stem relative to the sleeve to retract the locking dogs from the locking recess to permit lifting of the tool from the mandrel.

2. The tool set forth in claim 1 characterized by an instrument operatively connected to the upper end of the stem, a longitudinal passage through the stem communicating with the instrument, a pressure relief port in the sleeve, a pressure relief conduit extending laterally through the stem and communicating with the passage positioned to communicate with the pressure relief port when the stem is moved to the upper position relative to the sleeve, and sealing means engaging the stem and the sleeve adapted to prevent communication between the pressure relief conduit and the pressure relief port when the stem is in the lower position relative to the sleeve.

3. In apparatus for use in a well having a tubing string extending down a borehole, a landing nipple in and forming a part of the tubing string, and a locking mandrel having an opening extending longitudinally therethrough and a locking recess in the wall of the opening landed in the landing nipple, the improved tool adapted to be run into the locking mandrel and retrieved therefrom on a wire line comprising a housing at the upper end of the tool, a stem connected to the housing extending downwardly into the opening in the locking mandrel, sealing means around the stem adapted to engage the wall of the opening through the locking mandrel positioned to prevent flow through the locking mandrel between the stem and the locking mandrel, a passage through the stem communicating with the housing, a sleeve surrounding and longitudinally slidable relative to the stem, means limiting the longitudinal movement of the sleeve relative to the stem, locking dogs movable in the sleeve from an inner running position to an outer locking position extending into the locking recess of the locking mandrel, locking dog releasing means constructed and arranged to move the locking dogs to the inner running position on movement of the stem upwardly to an upper position, a pressure relief conduit extending laterally through the stem from the passage, a pressure relief port through the sleeve positioned to communicate with the pressure relief conduit when the stem is in the upper position, and sealing means engaging the stem and sleeve positioned to prevent communication between the pressure relief conduit and the pressure relief port when the stem is in the lower position.

4. A wire line operated tool for installation by wire line in a locking mandrel landed in a landing nipple in tubing in well, said locking mandrel having a longitudinal opening therethrough and a locking recess in the wall of the opening, said tool comprising a body, a sleeve concentric with the body and longitudinally slidable on the body, means limiting the longitudinal movement of the sleeve relative to the body, locking dogs movable in the sleeve from an inner running position to an outer locking position adapted to extend into the locking recess of the locking mandrel, means urging the locking dogs to the outer position when the body is in a lower position relative to the sleeve and allowing movement of the locking dogs to the inner running position on upward movement of the body to an upper position relative to the sleeve, a stinger extending downwardly below the sleeve and the body into the longitudinal passage of the locking mandrel, and sealing means extending around the stinger to engage the wall of the opening through the mandrel positioned to prevent flow through the locking mandrel between the locking mandrel and tool.

5. The wire line operated tool as set forth in claim characterized by a passage extending longitudinally through the stinger, a duct in the body communicating with the passage, and instrument means in the body communicating with the dust for developing a signal characteristic of a condition in the well at the lower end of the stinger.

6. The wire line operated tool as set forth in claim 5 characterized by the instrument means being constructed and arranged to generate an electric signal characteristic of the condition at the bottom of the stinger, and an electric line connected to the body for delivery of the signal to the well head.

7. The wire line operated tool of claim 4 wherein the weight of the body urges the body to a lower position maintaining the locking dogs in the outer position extending into the locking recess.

8. The wire line operated tool of claim 4 characterized by the means urging the locking dogs to the outer position including resilient means urging the body and sleeve in opposite directions and cam means on the dogs and body actuated by downward movement of the body relative to the sleeve to allow movement of the locking dogs into the locking recess.

9. Apparatus as set forth in claim 4 in which the locking dog releasing means comprise a cam surface extending from the body adjacent the locking dogs and a cam follower extending from the locking dogs and engaging the cam surface whereby on lifting the body the cam surface moves the cam follower inward.

10. The wire line operated tool as set forth in claim 5 characterized by a pressure relief port extending through the sleeve, a pressure relief conduit extending laterally through the body communicating with the duct and positioned to communicate with the pressure relief port when the body is moved to the upper position relative to the sleeve, and sealing means engaging the body and the sleeve to prevent flow through the pressure relief conduit when the body is in the lower position relative to the sleeve.

11. A wire line operated tool as set forth in claim 4 characterized by a passage extending longitudinally through the stinger to transmit to the body well conditions existing below the mandrel.

12. In apparatus for landing, setting and retrieving from a well on a wire line, said well having a tubing string extending down the well, a landing nipple in and forming a part of the tubing string, and a locking mandrel having a longitudinal opening therethrough and a locking recess in the wall thereof landed in the landing nipple, the improved tool comprising a tool body constructed and arranged to be run into and retrieved from the locking mandrel on a wire line, an instrument at the upper end of the tool, a stinger extending downwardly from the tool body into the locking mandrel, a passage extending longitudinally through the stinger communicating with the instrument whereby the instrument is exposed to below-mandrel well conditions, sealing means extending around the stinger adapted to engage the wall of the longitudinal opening through the locking mandrel positioned to prevent flow through the locking mandrel between the locking mandrel and the tool, locking dogs constructed and arranged to extend from the tool into the locking recess in the locking mandrel, and locking dog releasing means actuated by lifting the tool to allow movement of the locking dogs from the locking recess.

13. A wireline operated tool for installation in a tubular locking mandrel landed in a landing nipple in a tubing string extending down the borehole of a well comprising a stem adapted to move downwardly on a wireline into the locking mandrel, a passage extending longitudinally through the stem, sealing means adapted to engage the tool and mandrel to prevent flow between the tool and the mandrel, locking dogs constructed and arranged to move into a locking position engaging the mandrel to secure the stem at a lower position in the locking mandrel, said dogs having a sloping upper surface urging the dogs out of the locking position on upward movement of the stem relative to the locking mandrel, resilient means constructed and arranged to exert an upward force against the locking mandrel and a downward force against the stem to oppose upward movement of the stem relative to the locking mandrel, a pressure equalizing port for transmitting pressure from below the stem to above the locking mandrel when the stem is in an upper position relative to the locking mandrel, and sealing means engaging the outer surface of the stem positioned to prevent flow through the pressure equalizing port when the stem is at the lower position relative to the locking mandrel and permit flow through the pressure equalizing port when the stem is at an upper position relative to the locking mandrel.

14. A wireline operated tool as set forth in claim 13 characterized by an instrument operatively connected to the upper end of the stem and communicating with the passage through the stem for indicating well characteristics below the stem.

* * * * *

UNITED STATES PATENT AND TRADEMARK OFFICE

CERTIFICATE OF CORRECTION

PATENT NO. : 4,051,897

DATED : October 4, 1977

INVENTOR(S) : George F. Kingelin

It is certified that error appears in the above-identified patent and that said Letters Patent are hereby corrected as shown below:

Column 1, line 18, after "has" insert --been--.

Column 1, line 41, "pumoed" should be --pumped--.

Column 2, line 3, "test" should be --tests--.

Column 2, line 56, "wall" should be --well--.

Column 3, line 7, "sting" should be --string--.

Column 3, line 23, "cause" should be --causes--.

Column 3, line 24, "nippe" should be --nipple--.

Column 4, line 62, "wall" should be --well--.

Column 6, line 24, "hold" should be --hole--.

Column 6, line 27, cancel "the", first occurrence.

Column 6, line 30, cancel "if such instruments".

Column 6, line 48, after "After" insert --the--.

Column 8, line 14, after "claim" insert --4--.

Column 8, line 18, "dust" should be --duct--.

Signed and Sealed this

*Seventeenth* Day of *January 1978*

[SEAL]

*Attest:*

RUTH C. MASON
*Attesting Officer*

LUTRELLE F. PARKER
*Acting Commissioner of Patents and Trademarks*